US007905198B2

(12) United States Patent
Moon

(10) Patent No.: US 7,905,198 B2
(45) Date of Patent: Mar. 15, 2011

(54) ASCENT AND DESCENT APPARATUS FOR LIQUID MATERIAL SPRAY PRINTER

(75) Inventor: Hyung-Dae Moon, Seoul (KR)

(73) Assignee: Brain Union System Co., Ltd (KR)

( * ) Notice: Subject to any disclaimer, the term of this patent is extended or adjusted under 35 U.S.C. 154(b) by 1056 days.

(21) Appl. No.: 11/597,242

(22) PCT Filed: May 17, 2005

(86) PCT No.: PCT/KR2005/001449

§ 371 (c)(1),
(2), (4) Date: Nov. 20, 2006

(87) PCT Pub. No.: WO2005/113161

PCT Pub. Date: Dec. 1, 2005

(65) Prior Publication Data

US 2007/0227446 A1 Oct. 4, 2007

(30) Foreign Application Priority Data

May 20, 2004 (KR) ..... 10-2004-0036044

(51) Int. Cl.
*B66F 1/00* (2006.01)
*B05C 13/00* (2006.01)

(52) U.S. Cl. ..... 118/500; 118/663; 187/269; 254/122; 254/126

(58) Field of Classification Search ..... 254/126, 254/122; 187/269
See application file for complete search history.

(56) References Cited

U.S. PATENT DOCUMENTS 636,445 A * 11/1899 McCabe et al. ..... 187/269
943,936 A * 12/1909 Hunt ..... 187/262
3,003,746 A * 10/1961 Gridley ..... 254/9 C
3,404,791 A * 10/1968 Le Roy Larson ..... 414/572
(Continued)

FOREIGN PATENT DOCUMENTS

JP 58-116083 8/1983
(Continued)

OTHER PUBLICATIONS

Int'l Search Report (PCT/ISA/210) 3 pp.

*Primary Examiner* — Parviz Hassanzadeh
*Assistant Examiner* — Charles J Capozzi
(74) *Attorney, Agent, or Firm* — The Farrell Law Firm, LLP

(57) ABSTRACT

Disclosed is an ascent and descent apparatus for a liquid material spray printer, which may control a distance between a subject and a spray assembly optimally. The apparatus includes a sliding member having a pair of sliders selectively reciprocating oppositely by a driving unit; a frame installed above the sliders and having an elongated guide hole corresponding to a reciprocating range of the sliders; and a pair of crosslink members installed to an upper surface of the frame to couple with the sliders through the hole and whose upper end supports a flat table. The crosslink members include a pair of unit links hinged at their substantial center, whose lower ends are respectively coupled to the slider and hinged to the frame, and upper ends are respectively hinged to the flat table and supports the flat table rotatably, whereby the flat table is lifted by reciprocation of the sliders.

9 Claims, 2 Drawing Sheets

U.S. PATENT DOCUMENTS

| | | | | |
|---|---|---|---|---|
| 3,623,707 | A * | 11/1971 | Klopp | 254/22 |
| 5,222,860 | A | 6/1993 | Kamath et al. | |
| 5,927,877 | A | 7/1999 | Kelly et al. | |
| 6,281,990 | B1 | 8/2001 | Takahashi | |
| 6,652,054 | B2 | 11/2003 | Regev et al. | |
| 6,805,345 | B2 * | 10/2004 | Furukawa | 271/171 |
| 7,077,910 | B2 * | 7/2006 | Chappa et al. | 118/693 |
| 2004/0262490 | A1 * | 12/2004 | King, Jr. | 248/648 |

FOREIGN PATENT DOCUMENTS

| | | |
|---|---|---|
| JP | 06-039325 | 2/1994 |
| KR | 2000-0013939 | 3/2000 |
| KR | 2003-093420 | 12/2003 |

* cited by examiner

[Fig. 1]
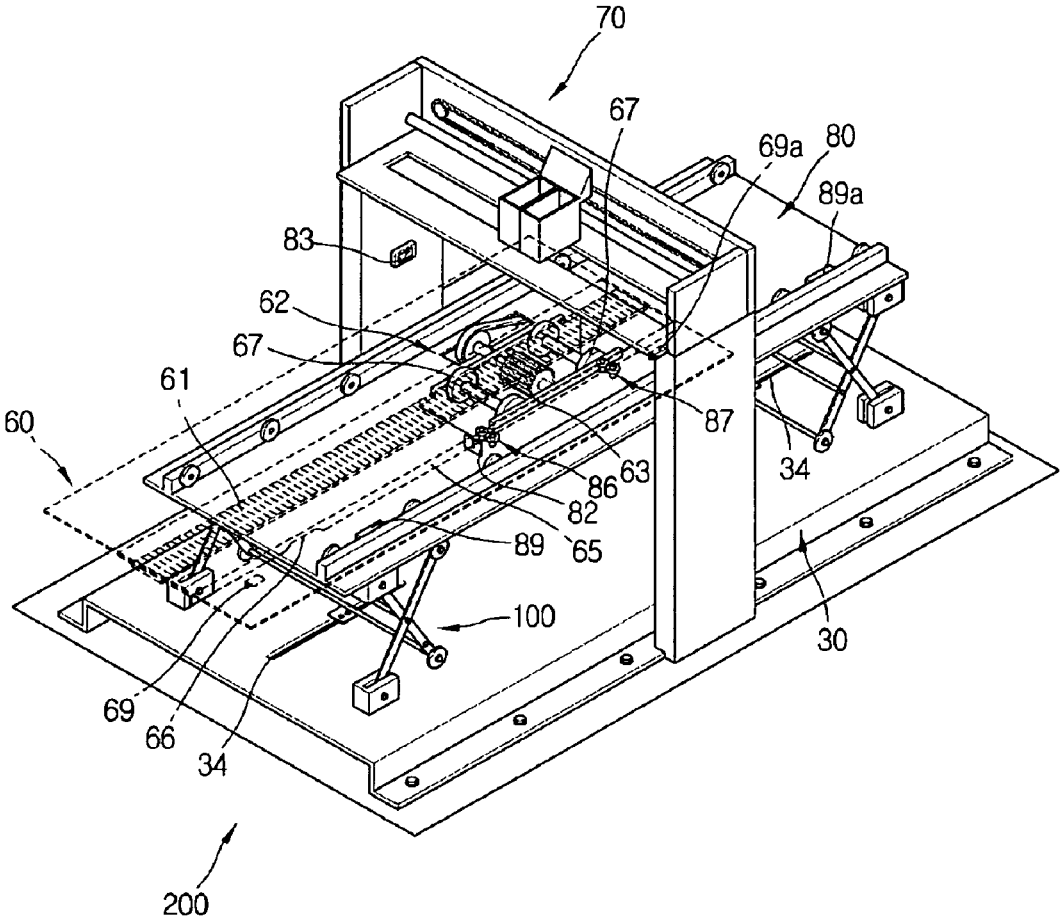
[Fig. 2]
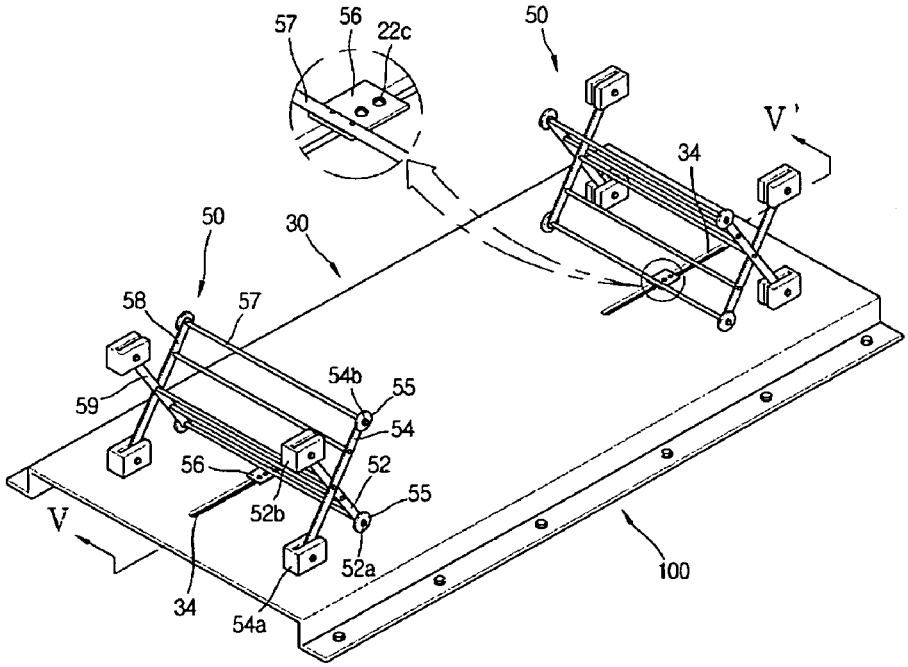

[Fig. 3]
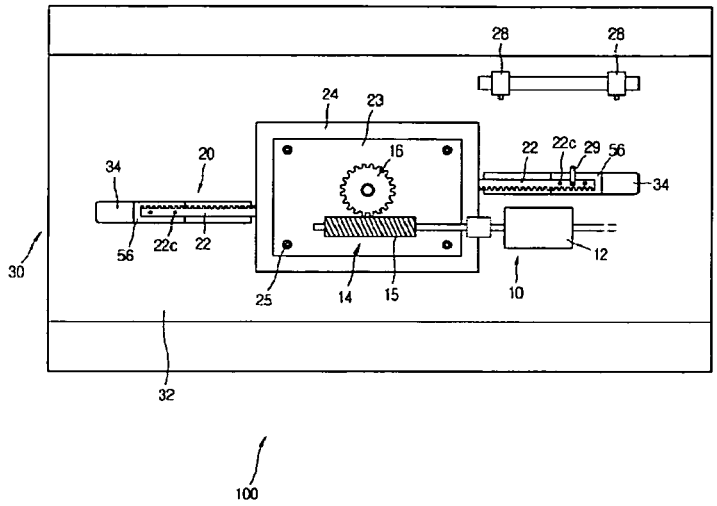
[Fig. 4]
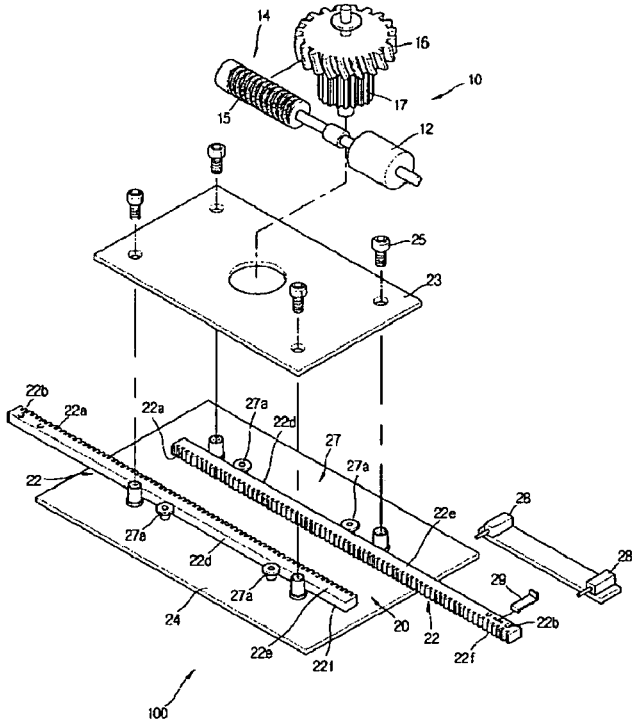
[Fig. 5]
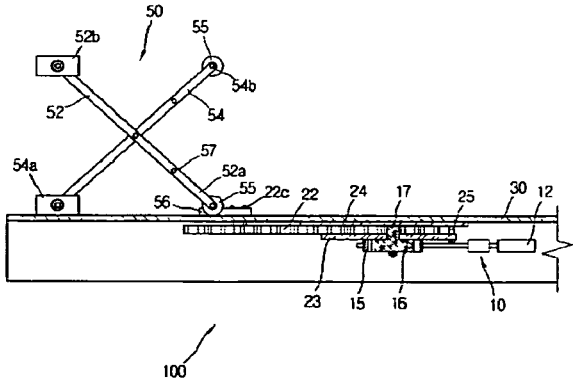

ASCENT AND DESCENT APPARATUS FOR LIQUID MATERIAL SPRAY PRINTER

TECHNICAL FIELD

The present invention relates to an ascent and descent apparatus for a liquid material spray printer, and more particularly to an ascent and descent apparatus for a liquid material spray printer, which may control a distance between a subject to be coated and a spray assembly optimally.

BACKGROUND ART

Generally, a liquid material spray printer is a device for coating liquid material on a surface of a subject to print a predetermined image. As an example of such a liquid material spray printer, there is an ink-jet printer that may coats an ink material for printing.

The liquid material spray printer includes a transferring table on which a subject to be coated is mounted, a transferring device for reciprocating the transferring table so that liquid material may be coated on the subject, an ascent and descent device for ascending/descending the transferring device to a height suitable for liquid material coating, and a spray assembly installed at a substantial center of the transferring device to be capable of reciprocating in a direction perpendicular to a moving direction of the transferring table. The spray assembly contains liquid material and is provided with a nozzle capable of spraying the liquid material to the subject to be coated.

The ascent and descent device is a device that lifts a subject transferred below the spray assembly by the transferring device to a height suitable for printing liquid material. Such an ascent and descent device is disclosed in Korean Utility Model Registration Nos. 20-0300098, 20-0292979 and 20-0290203.

The ascent and descent device includes a base plate, a lead screw rotatably installed along a length of the base plate and having threads in opposite directions based on a center point, a transferring block screwed to the lead screw and selectively reciprocating within a predetermined range by rotation of the lead screw, a guide bar installed to both sides of the lead screw to guide reciprocation of the transferring block and capable of being inserted into the transferring block, and a crosslink having one end supporting a predetermined flat table and the other end to which a pair of unit links hinged to the transferring block are hinged at their center so as to lift the flat table as the transferring block is reciprocating.

However, as described above, the ascent and descent device requires many components, so much cost is needed to manufacture and assemble the components. In particular, the ascent and descent device is not suitable for lifting a flat table with a large size since only one crosslink is installed to the lead screw. That is to say, in order to apply such an ascent and descent device to a flat table with a large size, such devices should be installed at several positions so that the flat table may be stably supported and lifted. However, using several ascent and descent devices deteriorates productivity of the liquid material spray printer and causes increase of its price. Thus, there is needed an ascent and descent device that may lift a flat table with a large size more effectively.

DISCLOSURE OF INVENTION

Technical Problem

The present invention is designed to solve the problems of the prior art, and therefore an object of the invention is to provide an ascent and descent apparatus for a liquid material spray printer, which may lift a flat table using simple components in an effective way.

Another object of the invention is to provide an ascent and descent apparatus that may be effectively applied to a flat table with a large size.

TECHNICAL SOLUTION

In order to accomplish the above object, the present invention provides an ascent and descent apparatus for a liquid material spray printer, which includes a sliding member having a pair of sliders selectively reciprocating in opposite directions by a driving unit; a frame installed above the sliders and having an elongated guide hole formed at a position corresponding to a reciprocating range of the sliders; and a pair of crosslink members installed to an upper surface of the frame to be respectively coupled with the pair of sliders through the elongated guide hole, the crosslink members having an upper end that supports a predetermined flat table, wherein the crosslink members include a pair of unit links that are hinged at a substantial center thereof, in which a lower end of one of the pair of unit links is coupled to the slider and a lower end of the other of the pair of unit links is hinged to the frame, in which an upper end of one of the pair of unit links is hinged to the flat table and an upper end of the other of the pair of unit links supports the flat table rotatably, whereby the flat table is lifted by means of reciprocation of the sliders.

Preferably, the pair of sliders are installed with a predetermined interval therebetween and have rack gears formed on sides thereof facing with each other, the driving unit includes a pinion gear in the predetermined interval so that the pinion gear is engaged with the rack gear, and the pair of sliders are reciprocated in opposite directions by means of rotation of the pinion gear.

More preferably, the crosslink members further include another pair of unit links connected to the pair of unit links by means of a connection member so that two pairs of unit links support the flat table.

In addition, it is preferred that the sliding member further includes a support roller installed in the reciprocating range so as to support reciprocation of the sliders.

Moreover, it is also preferred that the sliding member further includes a sensor for sensing reciprocation of the sliders; and a controller for controlling operation of a driving motor according to a signal from the sensor, whereby the reciprocating range of the sliders is selectively controlled.

BRIEF DESCRIPTION OF THE DRAWINGS

These and other features, aspects, and advantages of preferred embodiments of the present invention will be more fully described in the following detailed description, taken accompanying drawings. In the drawings:

FIG. 1 is a perspective view showing a liquid material spray printer to which an ascent and descent apparatus for a liquid material spray printer according to a preferred embodiment of the present invention is installed;

FIG. 2 is a perspective view showing an ascent and descent apparatus for a liquid material spray printer according to a preferred embodiment of the present invention;

FIG. 3 is a bottom view of FIG. 2;

FIG. 4 is an exploded perspective view of FIG. 3; and

FIG. 5 is a sectional view taken along V-V' line of FIG. 2.

BEST MODE FOR CARRYING OUT THE INVENTION

The present invention will be described in detail referring to the drawings the terms used should not be construed as limited to general and dictionary meanings but based on the meanings and concepts of the invention on the basis of the principle that the inventor is allowed to define terms appropriate for the best explanation. Therefore, the description herein the scope of the invention be understood that other and modifications could be made thereto without departing from the spirit and scope of the invention.

The present invention relates to an ascent and descent apparatus for a liquid material spray printer, which lifts a flat table to which a subject to be coated is mounted to a height suitable for coating liquid material. FIG. 1 is a perspective view showing a liquid material spray printer to which an ascent and descent apparatus for a liquid material spray printer according to a preferred embodiment of the present invention is installed, and FIG. 2 is a perspective view showing an ascent and descent apparatus for a liquid material spray printer according to a preferred embodiment of the present invention. In addition, FIG. 3 is a bottom view of FIG. 2, and FIG. 4 is an exploded perspective view of FIG. 3.

Referring to FIGS. 1 to 4, the ascent and descent apparatus 100 for a liquid material spray printer includes a driving unit 10, a sliding member 20 having a pair of sliders 22 reciprocated by the driving unit 10, a frame 30 installed above the sliding member 20, and a pair of crosslink members 50 installed to the upper surface of the frame 30 and respectively coupled to the pair of sliders 22 to lift a flat table 80.

The driving unit 10 includes a driving motor 12, and a gear assembly 14 for transferring a driving force of the driving motor 12. The driving motor 12 is commonly used and preferably controlled by a controller (not shown), described later.

The gear assembly 14 includes a worm 15 connected to the driving motor 12, a worm wheel 16 converting rotational force of the worm 15 into vertical movement, and a pinion gear 17 integrated with the worm wheel 16. The pinion gear 17 is installed between the pair of sliders 22 to give a driving force to the pair of sliders 22 respectively. Meanwhile, the worm 15 and the worm wheel 16 have common configurations.

The sliding member 20 includes an upper plate 23, a lower plate 24, and a pair of sliders 22 installed between the upper and lower plates 23, 24 and reciprocating in opposite directions by the driving unit 10.

The upper and lower plates 23, 24 are installed with a predetermined interval and support reciprocation of the sliders 22. The lower plate 24 is installed to the lower surface 32 of the frame 30, while the upper plate 23 is installed with a space that substantially allows reciprocation of the sliders 22. The upper and lower plates 23, 24 are coupled to each other by means of a coupling member 24 such as a screw.

The pair of sliders 22 are installed with a predetermined intervals on the center of the pinion gear 17, and rack gears 22*a* to be engaged with the pinion gear 17 are formed on their sides facing with each other. That is to say, since the pinion gear 17 and the rack gear 22*a* are engaged with each other, as the pinion gear 17 rotates, the pair of sliders 22 rotate in opposite directions.

The slider 22 has a coupling groove 22*b* for coupling with the crosslink member 50. The coupling groove 22*b* is formed at a predetermined position of the slider 22 so that a coupling member 22*c* is installed therein to couple the crosslink member 50 and the slider 22. Preferably, a spiral ridge is formed on an inner surface of the coupling groove 22*b* to allow screwing.

Preferably, the sliding member 20 includes a support roller 27 supporting reciprocation of the slider 22. More preferably, the support roller 27 includes a first support roller 27*a* for supporting a side 22*d* of the slider 22, and a second support roller (not shown) for supporting an upper surface 22*e* and a lower surface 22*f* of the slider 22.

The first support roller 27*a* supports the side of the slider 22 to prevent the slider 22 from shaking right and left. Preferably, at least two first support rollers 27*a* are installed in the reciprocating range. It makes the pair of sliders 22 reciprocate in parallel with each other.

The second support roller (not shown) is installed to the upper and lower plates 23, 24 to support the upper and lower surfaces of the slider 22, and prevents the slider 22 from shaking up and down. Preferably, at least two second support rollers are installed in the reciprocating range. It allows the pair of sliders 22 to reciprocate in parallel with each other.

Preferably, the sliding member 20 includes sensors 28 for sensing reciprocation of the slider 22, and a controller (not shown) for controlling operation of the driving motor 12 according to a signal from the sensors 28.

The sensors 28 are installed at a predetermined position in the reciprocating range. The sensors 28 detect a protrusion 29 protruded from the slider 22 to sense reciprocation of the slider 22. Thus, the reciprocating range of the slider 22 may be controlled by adjusting a distance between the sensors 28.

The frame 30 is installed in contact with the lower plate 24, and has an elongated guide hole 34 formed at a position corresponding to the reciprocating range of the slider 22. As shown in FIGS. 2 and 3, the elongated guide hole 34 is formed along a moving direction of the slider 22 so that the coupling member 22*c* for coupling the slider 22 and the crosslink member 50 is inserted and installed therein.

The crosslink member 50 is coupled to the slider 22 through the elongated guide hole 34, and its upper end is installed to the upper surface of the frame 30 to support a predetermined flat table 80.

The crosslink member 50 includes a pair of unit links 52, 54 hinged with each other at its substantial center. The pair of unit links 52, 54 include a first unit link 52 having a lower end 52*a* coupled to the slider 22 and an upper end 52*b* supporting the flat table 80, and a second unit link 54 having a lower end 54*a* hinged to the frame 30 and an upper end 54*b* supporting the flat table 80.

One of the upper ends 52*b*, 54*b* of the first and second unit links 52, 54 is hinged to the flat table 80, and the other slidably supports the flat table 80. One of the upper ends 52*b*, 54*b* hinged to the table 80 is used for fixing the flat table 80, and the other slidably supporting the flat table 80 is used for lifting the flat table 80. Preferably, sliding rollers 55 are installed to the lower end 52*a* of the first unit link 52 and a sliding one among the upper ends 52*b*, 54*b* of the first and second unit links 52, 54.

The crosslink member 50 configured as above is slid as the slider 22 is reciprocating, thereby lifting the flat table 80 installed to its upper end.

Preferably, the crosslink member 50 further includes a pair of unit links 58, 59 connected to the pair of unit links 52, 54 by means of a connection member 57. That is to say, two pairs of unit links 52, 54, 58, 59 support the flat table 80.

More preferably, the crosslink member 50 includes connectors 56 interposed in a coupling portion with the slider 22 so that the unit links may be smoothly slid, as shown in FIGS. 2 and 3. The connectors 56 are respectively coupled to the slider 22 and the connection member 57 by using the coupling member 22*c*.

As mentioned above, the ascent and descent apparatus 100 for a liquid material spray printer according to the present invention may lift the flat table 80 effectively by using a simple configuration composed of the driving unit 10, the sliding member 20, the frame 30 and the crosslink member 50. In addition, since a pair of crosslink members 50 are operated at the same time by one driving motor 12, the apparatus of the present invention may be effectively applied to a flat plate with a large size.

Now, operation of the ascent and descent apparatus for a liquid material spray printer according to a preferred embodiment of the present invention will be described with reference to FIGS. 1 to 5. The ascent and descent apparatus 100 is installed to a liquid material spray printer 200 and works together with it, so the operation of the liquid material spray printer 200 is described together.

First, a subject (not shown) to be coated is mounted to the upper surface of a transferring table 60. The transferring table 60 is a metal flat plate reciprocating within a predetermined range by a transferring device 62. In its lower surface, a sub rack gear 61 to be engaged with a sub pinion gear 63 of the transferring device 62 and a metal guide member 65 guiding movement of the transferring table 60 are respectively installed.

The subject to be coated is preferably installed at a position corresponding to a concave groove 66 formed on the guide member 65. In this case, a sensor 82 may sense position of the subject and allow controlling operation of a spray assembly 70.

Subsequently, if a worker pushes an operation switch (not shown), a driving force is transferred to the sub pinion gear 63 and the sub rack gear 61 so that the transferring table 60 is moved below the spray assembly 70. That is to say, the transferring table 60 is moved to a position where the spray assembly 70 may print an image on the subject.

After the subject is moved below the spray assembly 70, a controller (not shown) and a height sensor 83 detect an actual distance between the spray assembly 70 and the upper surface of the subject, and then compares it with a predetermined optimal coating distance.

The ascent and descent apparatus 100 lifts the flat table 80 as much as a difference between the actual distance and the optimal coating distance. That is to say, the height sensor 83 and the controller control the subject to be lifted to the optimal coating distance.

After the coating distance is controlled optimally by the ascent and descent apparatus 100, the spray assembly 70 starts printing. As the printing work is progressed, the transferring table 60 moves at a predetermined speed.

Meanwhile, the flat table 80 is provided with a support roller 67 and guide rollers 86, 87 that support the transferring table 60.

The support roller 67 is a roller with a predetermined magnetism, and it is coupled to the metal transferring table 60 by magnetic force so as to prevent the transferring table 60 from shaking during movement.

The guide rollers 86, 87 are composed of two rollers installed at a predetermined interval between them. One of the guide rollers has a predetermined magnetism, and the interval is defined so that the guide member 66 may substantially pass through it with being guided. Since the metal guide member 66 moves in close contact with the roller having magnetism, it is possible to prevent the transferring table 60 from shaking during movement. Thus, an image may be printed in an exact and precise way.

The printing work comes to an end when the sensor 82 detects the concave groove 66 formed at a position corresponding to an end of the subject. That is to say, if the sensor 82 senses the concave groove 66, the controller stops liquid material coating and restores a nozzle to its initial position.

Subsequently, if a second sensing member 89*a* detects a first protrusion 69, the controller stops transferring a driving force so that the transferring table 60 stops advancing. Subsequently, the driving motor (not shown) transfers a driving force reversely so that the transferring table 60 moves rearward to a printing start position. The rearward movement of the transferring table 60 is stopped when a first sensing member 89 detects a second protrusion 69*a*.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

INDUSTRIAL APPLICABILITY

As described above, the ascent and descent apparatus for a liquid material spray printer according to the present invention gives the following effects.

First, the ascent and descent apparatus for a liquid material spray printer may lift a flat table effectively by using simple components.

Second, the ascent and descent apparatus for a liquid material spray printer may be effectively applied to a flat table with a large size.

The invention claimed is:

1. An ascent and descent apparatus for a liquid material spray printer, comprising:

a sliding member having a pair of sliders selectively reciprocating in opposite directions by a driving unit;

a frame installed above the sliders and having an elongated guide hole formed at a position corresponding to a reciprocating range of the sliders; and a pair of crosslink members installed to an upper surface of the frame to be respectively coupled with the pair of sliders through the elongated guide hole, the crosslink members having an upper end that supports a predetermined flat table, wherein the crosslink members include a pair of unit links that are hinged at a substantial center thereof, in which a lower end of one of the pair of unit links is coupled to the slider and a lower end of the other of the pair of unit links is hinged to the frame, in which an upper end of one of the pair of unit links is hinged to the flat table and an upper end of the other of the pair of unit links supports the flat table rotatably, whereby the flat table is lifted by means of reciprocation of the sliders.

2. The ascent and descent apparatus for a liquid material spray printer according to claim 1, wherein the pair of sliders are installed with a predetermined interval therebetween and have rack gears formed on sides thereof facing with each other, wherein the driving unit includes a pinion gear in the predetermined interval so that the pinion gear is engaged with the rack gear, and wherein the pair of sliders are reciprocated in opposite directions by means of rotation of the pinion gear.

3. The ascent and descent apparatus for a liquid material spray printer according to claim 2, wherein the crosslink members further include another pair of unit links connected to the pair of unit links by means of a connection member so that two pairs of unit links support the flat table.

4. The ascent and descent apparatus for a liquid material spray printer according to claim 3, wherein the sliding member further includes a support roller installed in the reciprocating range so as to support reciprocation of the sliders.

5. The ascent and descent apparatus for a liquid material spray printer according to claim 4, wherein the sliding member further includes:

a sensor for sensing reciprocation of the sliders; and a controller for controlling operation of a driving motor according to a signal from the sensor, whereby the reciprocating range of the sliders is selectively controlled.

6. The ascent and descent apparatus for a liquid material spray printer according to claim 1, wherein the flat table ascends as one of the pair of sliders is driven in a first direction and the other of the pair of sliders is simultaneously driven in a second direction opposite the first direction by the driving unit, wherein the flat table descends as the one of the pair of sliders is driven in the second direction and the other one of the pair of sliders is simultaneously driven in the first direction by the driving unit, and wherein the driving unit is positioned substantially between the crosslink members.

7. The ascent and descent apparatus for a liquid material spray printer according to claim 1, wherein the driving unit includes:

a worm drive for driving the first and second sliders, the worm drive including a worm and a worm wheel; and a motor for driving the worm drive.

8. The ascent and descent apparatus for a liquid material spray printer according to claim 1, further comprising:

a spray assembly for spraying a liquid material onto a subject positioned over the flat table, wherein the spray assembly is mounted at a predetermined height above the frame;

a height sensor for detecting a distance between the spray assembly and an upper surface of the subject;

a controller for controlling an ascent or descent of the flat table such that an upper surface of the subject is at a predetermined distance from the spray assembly.

9. The ascent and descent apparatus for a liquid material spray printer according to claim 8, further comprising:

a metal transferring table positioned over the flat table, such that the subject is positioned directly over the metal transferring table, wherein the metal transferring table has a first protrusion substantially towards one end of the metal transferring table and a second protrusion substantially towards another end of the metal transferring table;

a metal guide member extending along a bottom of the metal transferring table, wherein a the metal guide member has a concave groove substantially towards one end of the metal guide member;

at least one support roller provided in the flat table and magnetically coupled to the metal transferring table for supporting the metal transferring table as the metal transferring table moves relative to the flat table;

a plurality of guide rollers provided in the flat table to support the metal transferring table as the metal transferring table rests on the flat table, wherein at least one of support rollers is magnetic and contacts the metal guide member as the metal transferring table moves relative to the flat table;

first and second sensors provided in the flat table and positioned substantially towards opposite ends of the flat table for detecting when one of the first and second protrusions reaches one of the first and second sensors;

a groove sensor provided in the flat table positioned substantially towards a pair of the guide rollers for detecting when the concave groove reaches the groove sensor; and a transferring device including a sub pinion gear engaged with a sub rack gear in the metal transferring table for controlling movement of the metal transferring table relative to the flat table according to information provided by the first and second sensors and the groove sensor.

* * * * *